United States Patent [19]

Kobayashi et al.

[11] Patent Number: 4,505,072

[45] Date of Patent: Mar. 19, 1985

[54] CENTRIFUGAL ROTARY BARREL-TYPE FINISHING MACHINE

[75] Inventors: Hisamine Kobayashi; Toshiro Ishihara, both of Nagoya, Japan

[73] Assignee: Shikishima Tipton Manufacturing Co., Ltd., Aichi, Japan

[21] Appl. No.: 530,344

[22] Filed: Sep. 8, 1983

[30] Foreign Application Priority Data

Sep. 17, 1982 [JP] Japan ..... 57-162871

[51] Int. Cl.[3] ..... B24B 31/02

[52] U.S. Cl. ..... 51/164.2; 241/171; 366/135; 366/188

[58] Field of Search ..... 366/131, 135, 188; 241/171; 51/164 R, 164 A, 263

[56] References Cited

U.S. PATENT DOCUMENTS

| | | | |
|---|---|---|---|
| 1,714,312 | 5/1929 | Kennedy | 241/171 |
| 2,722,339 | 11/1955 | Saxon | 366/188 |
| 3,233,372 | 2/1966 | Kobayashi . | |
| 3,401,893 | 9/1968 | Reynolds | 241/171 |
| 3,823,512 | 7/1974 | Kobayashi . | |
| 3,855,740 | 12/1974 | Kobayashi . | |
| 4,041,648 | 8/1977 | Heiberger | 51/164.2 |
| 4,104,831 | 8/1978 | Kobayashi . | |

FOREIGN PATENT DOCUMENTS

| | | | |
|---|---|---|---|
| 2702430 | 7/1978 | Fed. Rep. of Germany | 51/164 A |

*Primary Examiner*—Harold D. Whitehead

*Attorney, Agent, or Firm*—Wenderoth, Lind & Ponack

[57] ABSTRACT

A centrifugal rotary barrel-type finishing machine makes use of the produced centrifugal force for the purpose of the work surface finishing, stirring, mixing and/or milling, including work or material handling upright tubs, each having a top opening and a bottom opening to be closed and reopened by a top cover and a bottom cover, respectively, the top cover being capable of moving up and down and thereby closing and reopening the top opening, and the bottom cover including a hinged-plate pivotally supported at one end, thereby simplifying the discharging and recharging operation of the contents.

4 Claims, 7 Drawing Figures

CENTRIFUGAL ROTARY BARREL-TYPE FINISHING MACHINE

BACKGROUND OF THE INVENTION

1. Field of the Invention

The present invention pertains to a work or material handling machine having rotary barrels containing works or materials to be surface-finished, stirred, mixed or milled, and more particularly to a centrifugal rotary barrel-type finishing machine which causes a set of barrels to both turn on their respective axes and revolve around their common central axis, placing the contents under the resulting centrifugal force and thus subjecting them to the surface-finishing or polishing, stirring, mixing, or milling process, wherein means is provided for automatic charging and discharging of works or materials into and out of the barrels.

2. Description of the Prior Art

The rotary barrel finishing machine of the kind disclosed herein is known, which includes a pair of upper and lower turrets between which a number of work finishing tubs are arranged. In this prior art machine, the turrets are rotated at a high speed while the tubs on the turrets are also turned around on their respective axes, thus producing a centrifugal force equal to several or several ten times the gravitational acceleration. In this way, the contents within each of the individual tubs are placed under the action of the produced centrifugal force, so that a circulating flow of the contents can take place within the tubs. The same machine has applications such as surface-finishing, stirring, mixing and milling, and provides a high working efficiency in those applications. Despite its high working efficiency, however, the machine has a problem in the charging and discharging of the materials into and out of the finishing tubs on the turrets, the operations of which require much labor and time. In order to solve the above problem, automatic charging and discharging methods have been studied in various ways. The solutions that are now practiced include the provision of tiltable tubs whereby the tilling of the tubs allows the discharging of the contents, and the provision of the tubs each equipped with a removable cover. Neither of the above solutions is satisfactory, however, since the first solution requires a complicated or sophisticated mechanism to permit a tilting of the individual tubs, and the second also requires a complicated mechanism because of the need of removing the covers away from the machine. Consequently, both of the solutions result in a very costly machine construction.

SUMMARY OF THE INVENTION

In obviating from the above-described problems, a principal object of the present invention is to provide a rotary barrel-type finishing machine including finishing tubs or barrels capable of both turning around on their respective axes and revolving around their common axis, for the purpose of subjecting the contents to the surface-finishing, stirring, mixing or milling processing, wherein each of the individual tubs is equipped with means which permits automatic closing and reopening of the top and bottom openings thereof, so that the automatic material charging and discharging can be provided, thus improving the total working efficiency with the resulting advantage of saving labor and time.

Another object of the present invention is to provide a fully automatic and simplified construction machine that can be built at less cost, which allows the closing and reopening operation for the tubs to occur automatically and with high reliability whenever necessary.

According to the present invention, the above objects are achieved by providing a cover near the top of each of the upright tubs or barrels that is capable of being depressed by the downward force from the top to allow the top of the tub to open, and also by providing a lid on the bottom of each tub that is fixed to a hinged plate by means of spring-loaded rods, the hinged plate having a recessed end which disengageably engages the counterpart hook. In its closed position, the bottom lid has its recessed end engaging the hook, and when it is disengaged from the hook, it allows the bottom of the tub to open.

BRIEF DESCRIPTION OF THE DRAWINGS

Those and other objects and advantages will become more clearly apparent from the description that follows with an aid of the accompanying drawings that illustrate several preferred embodiments of the invention, in which.

DETAILS OF THE PREFERRED EMBODIMENTS

Figure 1:
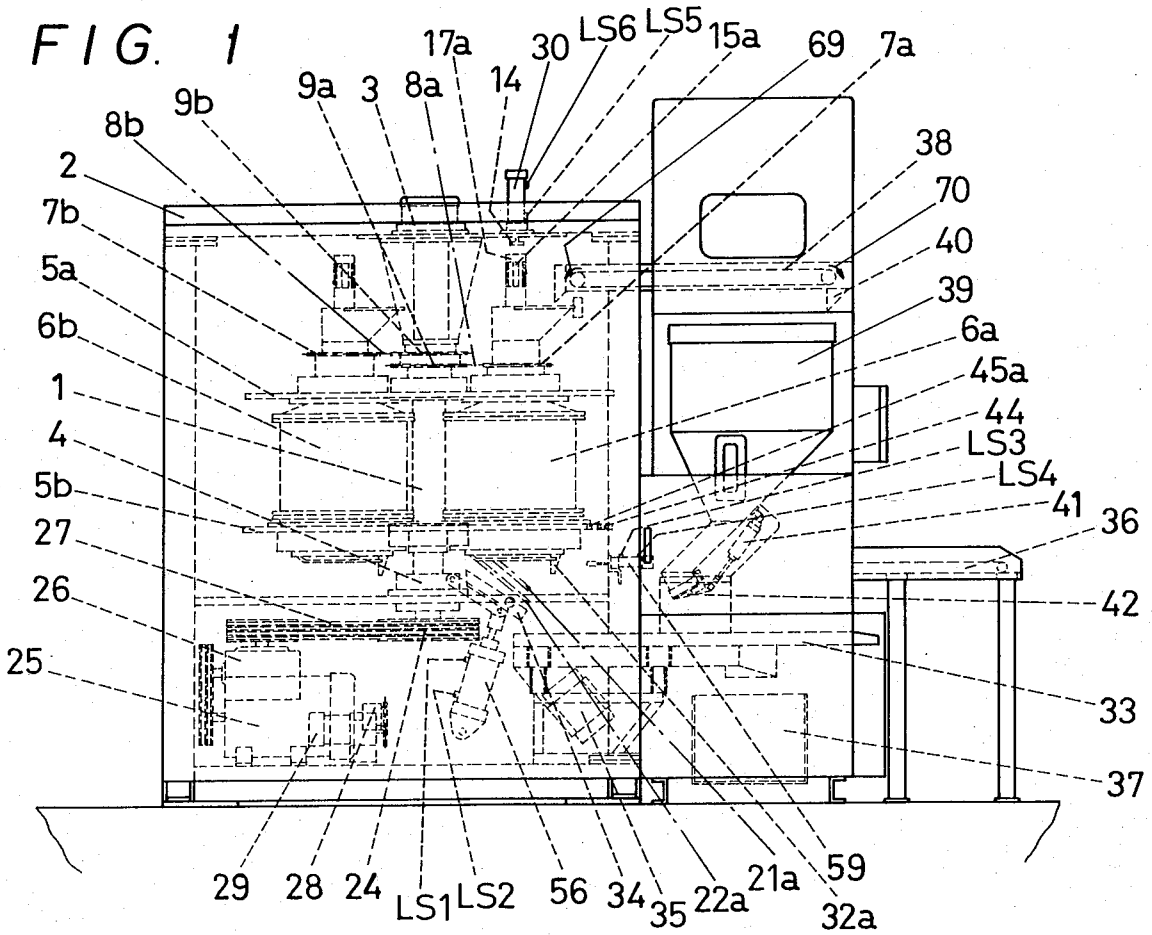
FIG. 1 is a front elevation showing the general construction of the machine according to a typical preferred embodiment of the present invention.
Figure 2:
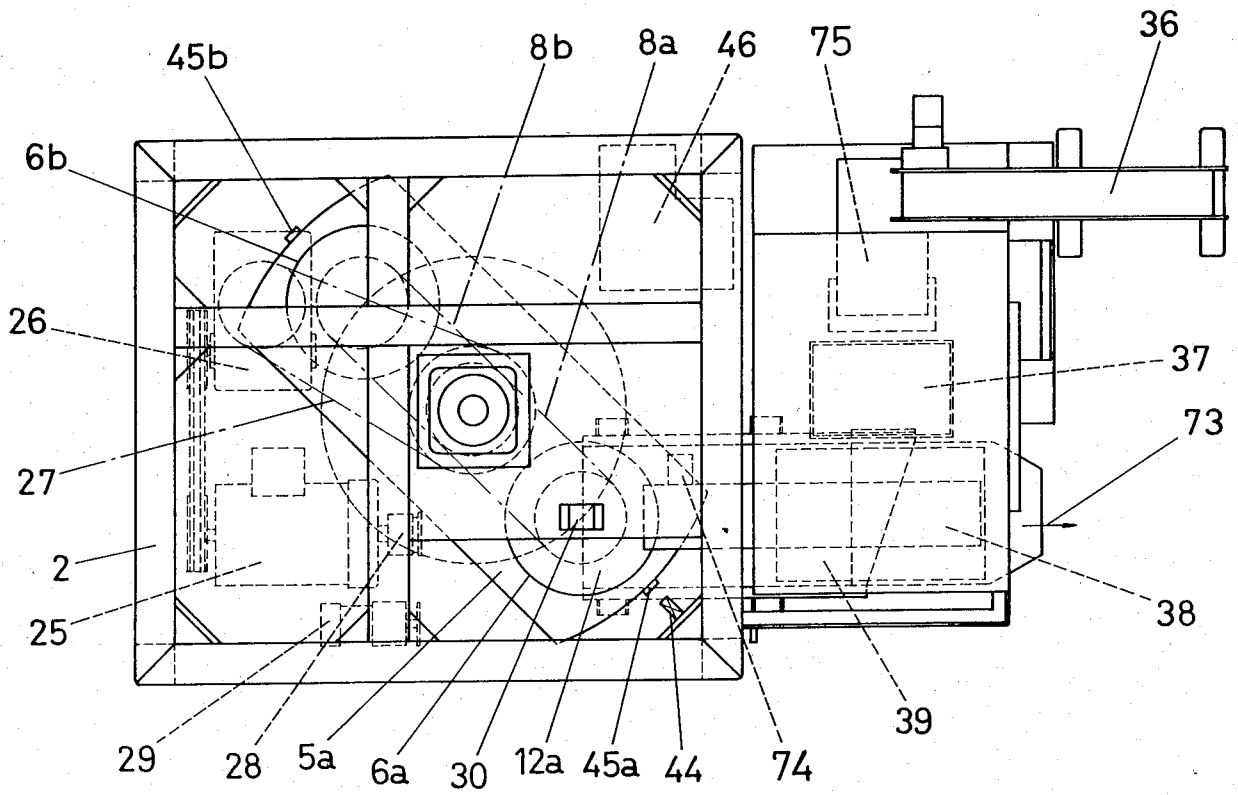
FIG. 2 is a plan view of the machine construction shown in FIG. 1.
Figure 3:
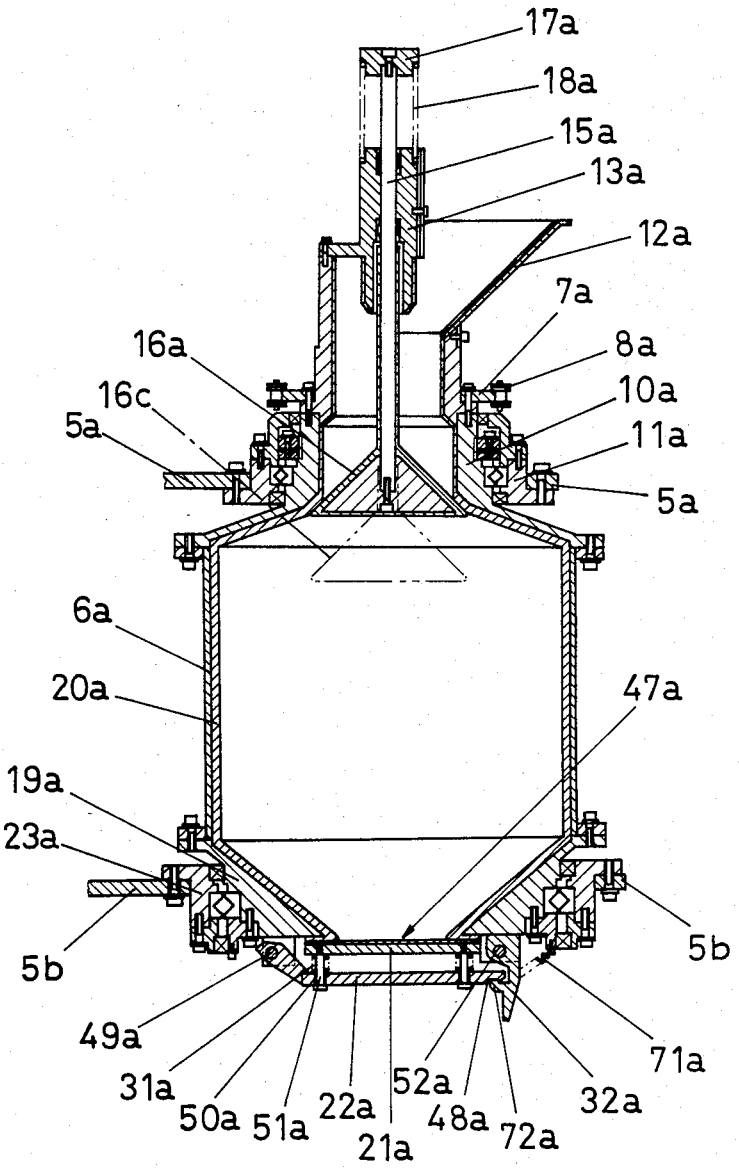
FIG. 3 is a sectional view, on an enlarged scale, of any one of the finishing tubs or barrels in the machine construction in FIG. 1, showing the details of the tub.
Figure 4:
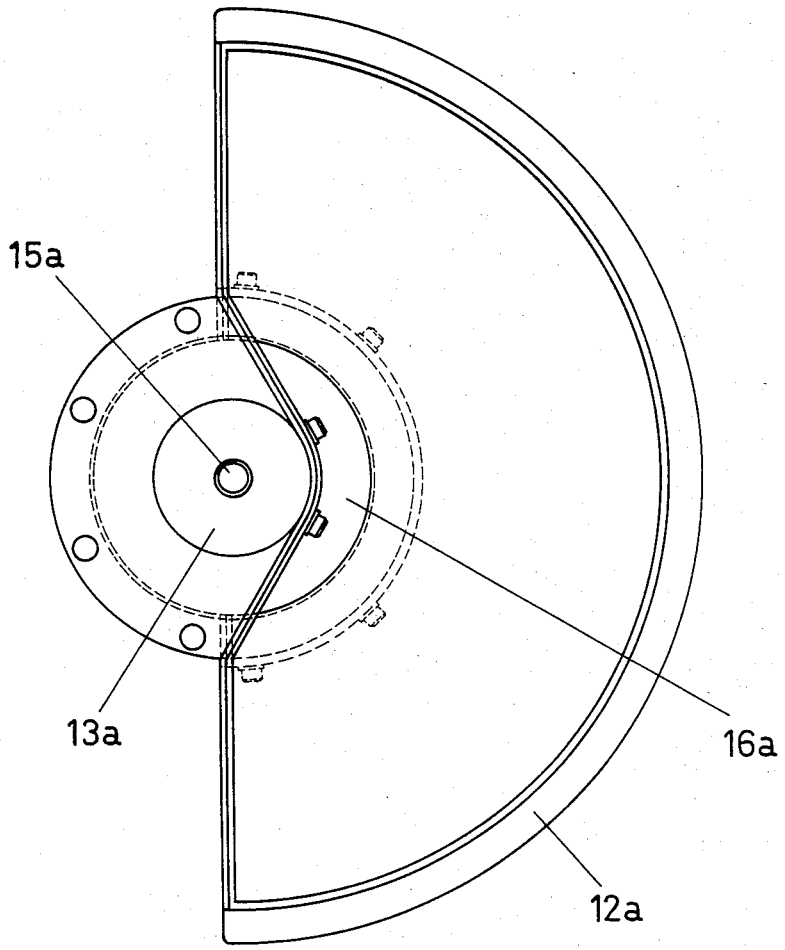
FIG. 4 is a plan view, on an enlarged scale, of a funnel-shaped part in a semi-circular shape in plane in the machine construction in FIG. 1.

In the following description, a preferred embodiment of the present invention is presented, the details of which are shown in the accompanying drawings. In FIGS. 1 and 2, the construction of the machine according to the present invention is shown. As particularly shown in FIG. 1, which is a front elevation view, the machine includes a work finishing compartment enclosed by a housing 2. Within the housing 2, a central main vertical shaft 1 is provided, the upper end of which is rotatably supported by a bearing 3 which is secured to the top frame of the housing 2, and its lower end is also rotatably supported by a bearing 4 which is secured to a support plate across the housing 2. The main shaft 1 supports a pair of upper and lower turrets 5*a* and 5*b* which are spaced away from each other. Between the turrets 5*a* and 5*b*, a plurality of work finishing tubs or barrels 6*a*, 6*b* are mounted so that they can rotate with the turrets and turn around on their respective axes. The number of the tubs may be varied such as just one, but should preferably be more than one, which in this case should be arranged at regular intervals along the common circumference around the turrets so that the turrets and therefore the tubs can rotate with equilibrium and with stability. In the embodiment shown, two tubs are provided, but three or more tubs may be installed as mentioned above. In the description that follows, for the identifying purposes, the first tub and its associated parts or elements are given reference numerals accompanied by a subscript of "a", while the second tub and its associated parts or elements are given reference numerals accompanied by a subscript of "b" In FIG. 1, it is shown that the first tub 6a is placed at the charging and discharging station while the second tub 6b is not. Each of the tubs 6a and 6b has a chain or sprocket wheel 7a, 7b at the portion that extends through the upper turret 7b. The chain wheels 7a and 7b are linked to the corresponding chain or sprocket wheels 9a and 9b rigidly secured to the main shaft 7, by way of the respective chains 8a and 8b. The ratio of the number of the teeth for the wheels 7a and 7b to the number of the teeth for the wheels 9a and 9b (or the diameter ratio of pitch circles for both) determines the ratio of the number of revolutions for the turrets 5a and 5b to the number of axial rotations for the tubs 6a and 6b. When the ratio is equal, the optimum operating conditions can be satisfied. The tubs 6a and 6b may have any shape as viewed in transverse section, such as a round shape, but the experiments demonstrate that polygonal shapes having five to eight sides, for example, can best meet the requirements for the surface-finish processing in particular. Details of one tub 6a, for example, including the turrets 5a and 5b are shown in FIG. 3. Details of the other tub 6b are not shown, but are identical to the tub 6a. Although the parts or elements of the tub 6b are not explicitly indicated in FIG. 3, it should be understood that the following description which is to be presented in connection with the tub 6a by particularly referring to FIG. 3 applies similarly to the tub 6b. In the following description, therefore, the reference numerals for the corresponding parts or elements for the tub 6b are given in parentheses following those for the tub 6a, such as 10a (10b). The upper portion of the tub 6a (6b) that extends through the upper turret 5a includes an upper flange 10a (10b) which is bolted to the tub. The upper flange 10a (10b) is also supported by a bearing 11a (11b) secured to the upper turret 5a so that the flange can turn around on its axis relative to the turret 5a. A funnel-shaped receiver 12a (12b) which is semi-circular in horizontal plane as shown in FIG. 4 is fixed to the upper portion of the upper flange 10a (10b). A housing 13a (13b) which is adapted to receive a valve stem is fixed to the top end of the upper flange 10a (10b). The funnel 12a (12b) receives works or other materials to be processed, which are fed into the tub through the funnel and then through the interior of the upper flange 10a (10b).

The valve stem housing 13a (13b) receives a valve stem 15a (15b) which is slidably fitted through the housing 13a (13b). The valve stem 15a (15b) extends downwardly toward the tub, the bottom end of which has a valve body 16a (16b) secured thereto. The valve body 16a (16b) has a conical shape, and is lapped closely to contact the upper portion of the tub such that the surface of the valve body comes in intimate contact with the internal peripheral wall of the upper tub portion. When the valve stem is completely raised, its valve body closes the top opening of the tub, as indicated by the solid-line valve body. In its closed position, the valve body can effectively prevent the contents from escaping or leaking through the top opening while they are being processed under the action of the centrifugal force. The valve body may be provided with vent holes of gases that may be produced inside, although they are not shown in FIG. 3. Providing such gas vent holes depends upon the type of processing that requires the vent holes, and, if provided, can prevent any increase in the internal pressure. The upper end of the valve stem 15a (15b) is seated in a valve seat 17a (17b), which is connected to the valve stem housing 13a (13b) by means of a spring 18a (18b). The spring 18a (18b) normally biases the valve seat 17a (17b) upwardly, placing the valve body 16a (16b) to its closed position. When the valve seat 17a (17b) is depressed against the spring 18a (18b), compressing the spring, the valve stem 15a (15b) is forced to move downwardly, thus bringing the valve body to its open position as indicated by the dot-dash line 16c in FIG. 3. The tub 6a (6b) has a lower flange 19a (19b) which is supported by a bearing 23a (23b) so that the tub can turn around on its axis relative to the lower turret 5b.

The interior of the tub 6a (6b) is entirely covered with a lining 20a (20b) of rubber or synthetic resin material. The lower flange 19a (19b) has a hinged plate 22a (22b) one end of which is pivotally supported by the lower flange 22a (22b). A bottom lid 21a (21b) is connected with the hinged plate 22a (22b) by means of a plurality of spring-loaded rods 51a (51b) which are arranged circumferentially around the plate and lid, the springs being referred to by 31a (31b). The other end of the hinged plate 22a (22b) has a recess 48a (48b) formed, which can disengageably engage a hook 32a (32b) mounted on the lower flange 19a (19b). Below the tub, there is provided a chute 34 which accepts the contents from the tub. The chute 34 includes an arm member 54 carrying a roller 55 on a free end side thereof, the opposite end of which is pivotally supported by the lower bearing 4 which has been described earlier. The details of the opening and closing operation of the bottom lid 21a (21b) will be presented later by referring to FIGS. 5 through 7, including other parts or elements associated with the lid opening and closing operation. Referring back to FIG. 1, the main shaft 1 has a main pulley 24 which is rigidly secured to the bottom end of the main shaft. The main pulley 24 is linked to reduction gears 26 by way of a belt 27, the reduction gears 26 being connected to a main motor 25. Output power of the main motor is controlled by the reduction gears 26 so that high speed power transmission can take place and can be delivered to the main shaft 1. A stepped (or indexing) motor with a brake 29 is linked to the main motor 24 by way of an electromagnetic clutch 28, and is used to provide a precise positioning of the tubs to the prescribed stop location, which is usually the charging and discharging position.

Figure 5:
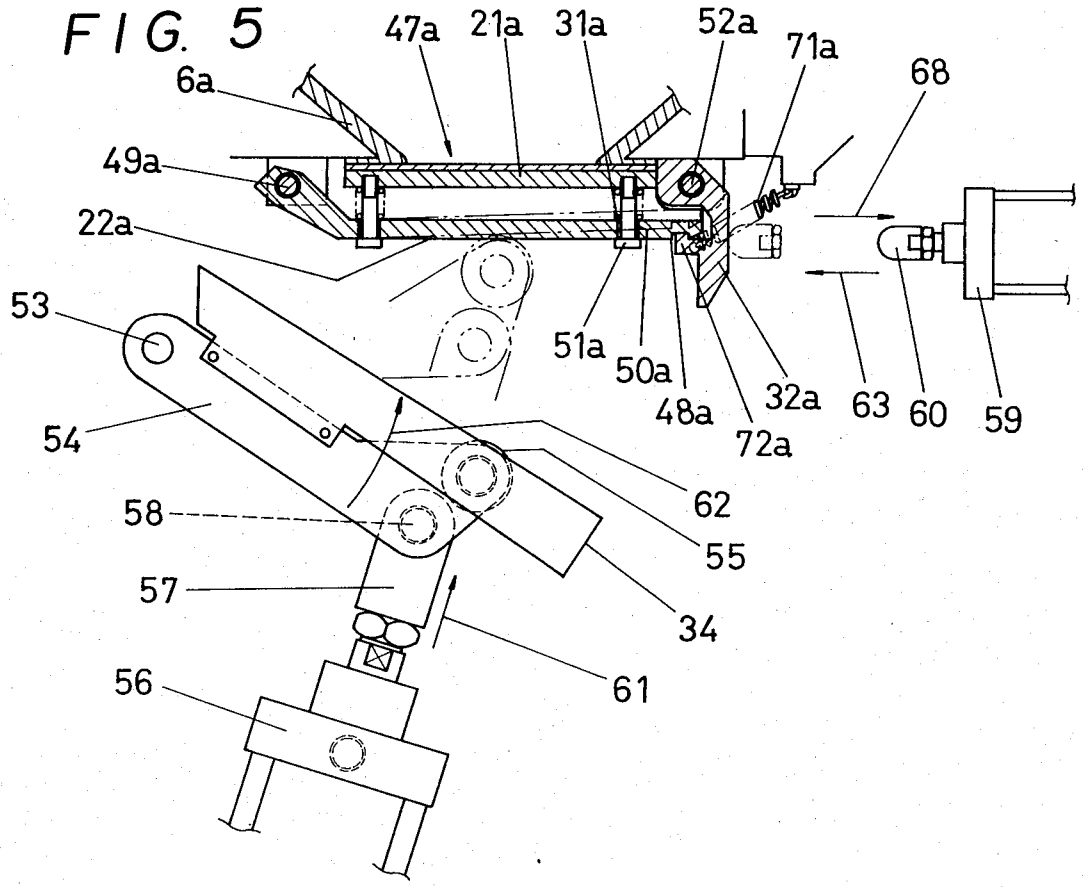
FIG. 5 is a partly sectional view, on an enlarged scale, of a lid at the bottom of the tub that is placed in its closed position.
Figure 6:
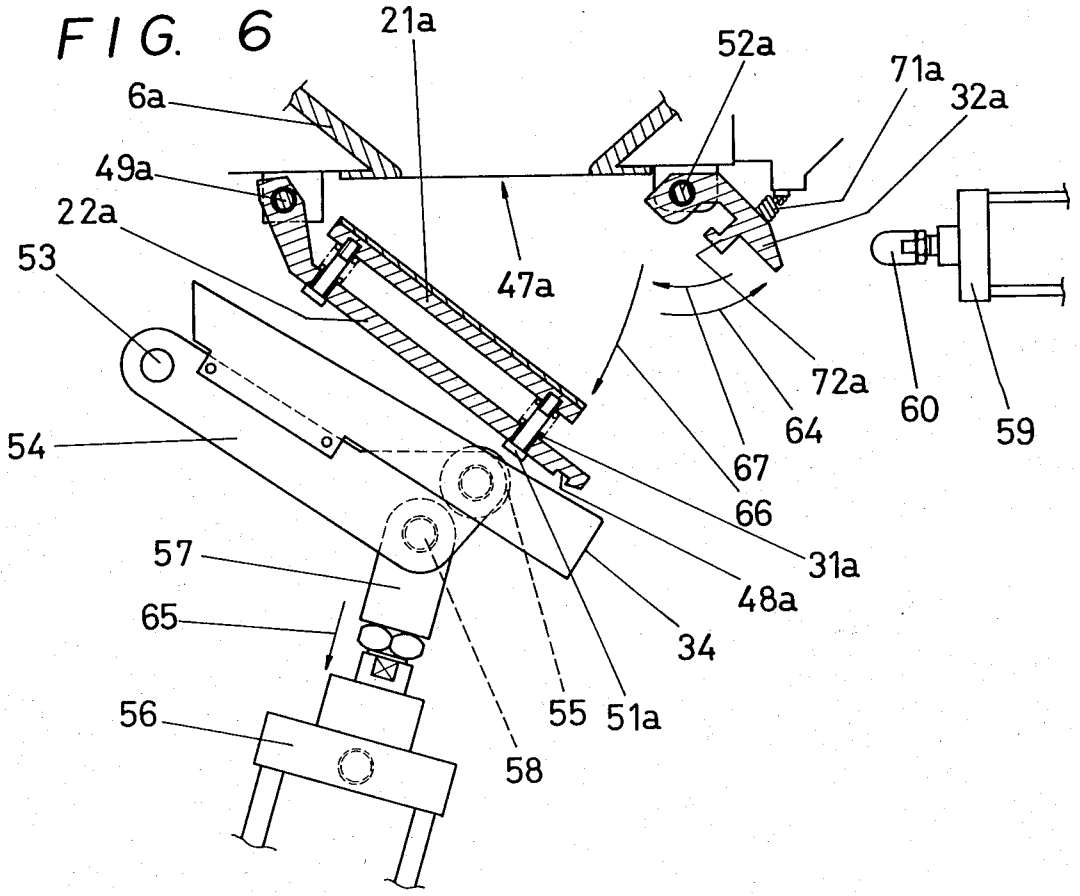
FIG. 6 is a partly sectional view, on an enlarged scale, of the bottom lid in its open position.
Figure 7:
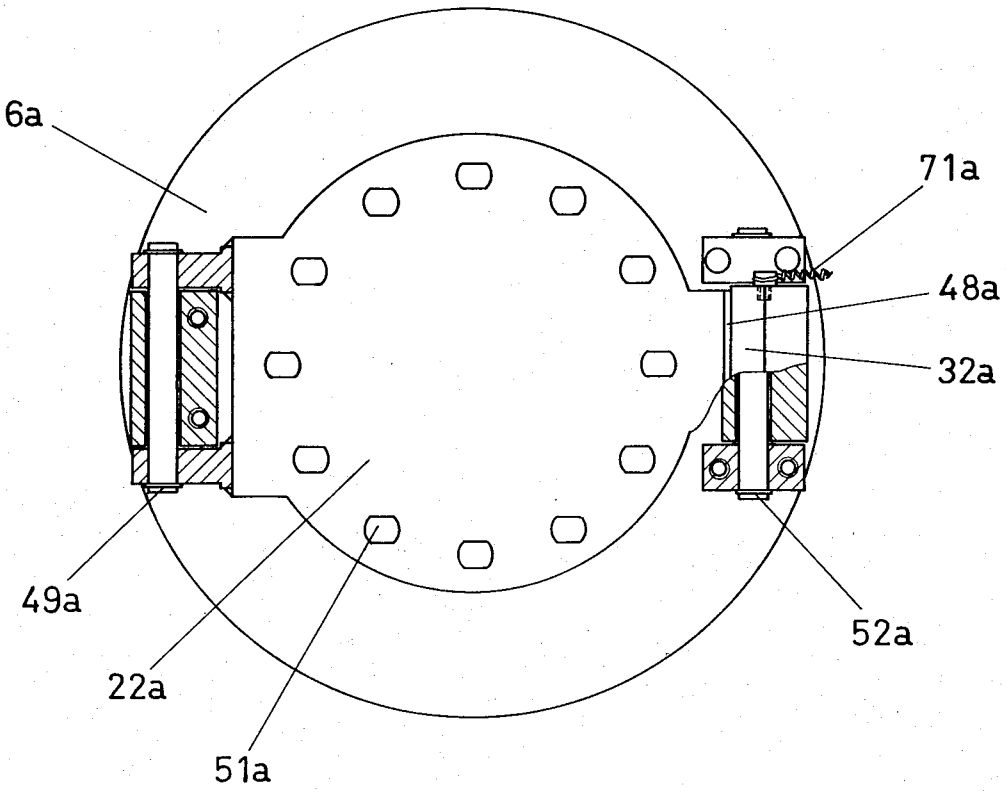
FIG. 7 is a plan view, on an enlarged scale, of the location where the bottom lid is hinged and is disengageably to engage the counterpart hook on the side of the tub, with some internal parts exposed visibly.

As shown in FIGS. 1 and 2, a structure stands beside the right-hand side of the housing 2, and contains a mass separator 33 which allows a mass, or mixture of works and abrasive media, to be separated into those two, a work feed conveyor 36, a bucket 37, media return conveyor 38, and a media hopper 39. A cylinder 30, which is located on the top frame of the housing 4, is provided for acting upon the valve so that it can open and close the top opening of the tub in its stop position, and may be pneumatically or hydraulically operated. The operation of the cylinder 30 is such that when pressurized fluid is introduced into the piston side of the cylinder, it causes its piston rod 14 to be moved downwardly and then the piston rod 14 is brought to contact with the valve seat 17*a* (for the tub 6*a* in this case, as shown), depressing the valve seat which allows the valve body 16*a* to reopen the top opening of the tub 6*a* through the valve stem 15*a* connected to the valve body 16*a*. Restoring of the valve body to its normally closed position can occur by means of the tension coil spring 18*a* when the cylinder 30 is released. Detailed construction including the lower lid 21*a* (21*b*), hinged plate 22*a* (22*b*), hook 21*a* (21*b*), and the other parts that control the opening and closing of the lower lid is shown in FIGS. 5 through 7. In those figures, the tub 6*a* (6*b*) is open at the bottom 47*a* (47*b*), and a hinged plate 22*a* (22*b*) having a recess 48*a* (48*b*) at one end is pivotally connected to an extension of the tub on one side thereof by means of a hinged pin 49*a* (49*b*) which is inserted in parallel with the bottom opening 47*a* (47*b*). The hinged plate 22*a* (22*b*) carries a plurality of bolt insertion holes 50*a* (50*b*) which are arranged at equal angular intervals circumferentially of the hinged plate 22*a* (22*b*). Similarly, the bottom lid 21*a* (22*b*) carries bolt receiving holes at the positions corresponding to those in the hinged plate, the holes on the lid being internally threaded. Connection between the bottom lid and hinged plate is made by means of spring-loaded bolts 51*a* (51*b*) which pass through the hinged plate to permit a sliding of it and are secured to the bottom lid, the springs being indicated by 31*a* (31*b*). The bottom lid and hinged plate are thus connected so that the two can be maintained in spaced-relationship by the elastic action of the springs. An extension of the tub on the other side has a hook member 32*a* (32*b*) one end of which is pivotally connected to the extension by means of a hinged pin 52*a* (52*b*) which is inserted in parallel with the bottom opening 47*a* (47*b*). The other side of the hook 32*a* (32*b*) has a nail 72*a* (72*b*), which is adapted to disengageably engage the recess 48*a* (48*b*) on the hinged plate 22*a* (22*b*). A tension coil spring 71*a* (71*b*) one end of which is fixed to the portion outside the bottom opening of the tub and the other end of which is secured to the hook 32*a* (32*b*), normally biases the hook toward the direction of the pulling force provided by the spring. Below the hinged plate 22*a* (22*b*), there is disposed a arm member 54 one end of which is pivotally supported by the lower bearing 4 by means of a pin 53, the arm member having on the other side a roller 55 which is adapted to be brought into contact with the hinged plate 22*a* (22*b*). Reference numeral 34 denotes a chute which is secured to the arm member 54 and accepts the contents that are discharged from the tub through the bottom opening. On the other side of the arm member 54, it is also pivotally connected to a piston rod 57 of a fluid-operated cylinder 56 by means of a pin 58 parallel with the pin 53 on the opposite side of the arm member 54. The cylinder 56 is rigidly secured to the machine housing 2. As such, when the cylinder 56 is activated by introducing pressurized fluid into the piston side, its piston rod 57 is pushed out in the direction of an arrow 61, causing the arm member 54 to turn about the pin 53 in the direction of an arrow 62. Then, the roller 55 on the arm member 54 travels as indicated by the dot-dash lines in FIG. 5, until it is brought into contact with the hinged plate 22*a* (22*b*). As the piston rod 57 is then further being pushed out, it tries to bring the hinged plate nearer to the lid 21*a* (21*b*) against the action of the springs 31*a* (31*b*), as indicated by the dot-dash lines in FIG. 5. For the operation of the hooked portion 32*a* (32*b*), a fluid-operated cylinder 59 is located on the outside of the hooked portion and is secured to the machine housing 2. When the cylinder 59 is activated by having pressurized fluid introduced into the piston side, its piston rod 60 advances toward the hook member 32*a* (32*b*) as indicated by an arrow 63, until it reaches the hook member. As the piston rod further advances it causes the hook member to turn around the pin 52*a* toward the hinged plate against the action of the tension coil spring 71*a*. Thus, the nail on the hook member can engage the recess on the hinged plate, this operation being controlled electrically as described in detail later.

An example of positioning of the turrets to the prescribed stop location is shown in FIGS. 1 and 2, and this is controlled by a combination of a micro switch 44 mounted on the machine housing 2 and a dog 45*a* (45*b*) mounted on the lower turret 5*b*, whereby the micro switch 44 is responsive to the presence of the dog 45*a* (45*b*) so that a signal delivered by the switch allows the turrets to be stopped at the above location.

The operation of the machine whose constructional features have fully been illustrated is now described. It should be understood in connection with the following description that, as a principle of operation, the machine is designed to provide fully automatic sequential operation of all the individual elements that are operational, and can run in unattended mode, but some of the operation may be manual, such as in the case where, upon completion of the machine proper operation, it is required that the machine operation proceeds to any other processing outside this machine operating environment. In addition, the sequencial control is provided by making use of the per-se known sequencer, which is programmed to allow one completion signal for one step to enable the next sequential step to start, all the subsequent steps being repeated in the above manner until one complete cycle of the operation is finished. The time period for each one complete cycle is controlled by means of a timer. The following description applies to the work surface-finish processing, but can be true for other processings such as stirring, mixing, etc. At the end of the time period preset by the timer which indicates the completion of one cycle, the main motor 25 is turned off, bringing the turret pair 5*a* and 5*b* to rest. Then, the electromagnetic clutch 28 is actuated, which drives the stepped motor with a brake 29. The stepped motor causes the turret pair 5*a* and 5*b* to be rotated in short and uniform angular movements, and when the micro switch 44 senses the presence of the dog 45*a* on the turret 5*b*, it delivers an output signal representing the completion of the operation. The signal actuates the brake on the stepped motor, which forcedly stops the stepped motor, thus bringing the turret pair 5*a* and 5*b* to rest at the prescribed stop position. The output signal from the micro switch 44 also actuates the vibratory motor 35 for the mass separator 33, and at the same time causes pressurized fluid to be introduced into the piston side of the fluid-operated cylinder 5*b*. Thus, the piston rod 57 in the cylinder is moved forward in the direction of an arrow 61 in FIG. 5. As the piston rod 57 is advancing, it acts upon the arm member 54 so that the arm link 54 can turn around the pivotal pin 53 in the direction of an arrow 62. The turning of the arm link 54 continues until its roller 55 reaches the hinged plate 22*a* in its closed position, as indicated by the dot-dash lines in FIG. 5. After the contact, the arm member 54 is further advanced, causing its roller 55 to push the hinged plate 22*a* toward the bottom lid 21*a* against the action of the springs 31*a*, as indicated by the dot-dash lines. The pushing force of the roller 55 causes the hinged plate 22*a* to turn around the hinged pin 49*a*, thus bringing the recessed side of the hinged plate nearer to the bottom lid 21*a*. This action releases the hinged plate from the hook member 32*a* by moving the recessed end 48*a* of the hinged plate 22*a* away from the nail 72*a* of the hook member 32*a*. When the piston rod 57 is completely extended, it is detected by the limit switch $LS_1$ mounted on the exterior of the cylinder 56 (all limit switches will hereinafter be referred to simply as $LS_x$, where x is a number, and the term "limit switch" is omitted for simplicity) which responds to a magnet (not shown) attached on the piston within the cylinder 56. As the hinged plate 22*a* is moved away as described above, the hook member 32*a* which is biased by the tension spring 71*a* toward the spring side is turned around the pin 52*a*, moving backward in the direction of an arrow 64. Thus, the two members are completely disengaged. An output signal of $LS_1$ enables pressurized fluid to be introduced into the piston rod side of the cylinder 56, causing the piston rod 57 to retract in the opposite direction as indicated by an arrow 65. When the piston rod is completely retracted, this is detected by $LS_2$ on the exterior of the cylinder 56, which stops the operation of the cylinder. As the roller 55 is being moved away from the hinged plate 22*a* which was pressed by the roller, the hinged plate is being restored to its original position as indicated by the solid lines in FIG. 5, under the action of the compression springs 31*a*, and is then being turned around the pin 49*a* by itself, moving down with the bottom lid 21*a* in the direction of an arrow 66 in FIG. 6 and thus leaving the bottom of the tub open at the opening 47*a*. The contents in the tub are thus discharged through the opening 47*a*. The output signal of $LS_2$ on the cylinder 56 also actuates the fluid-operated cylinder 30, causing pressurized fluid to be introduced into the piston side of the cylinder 30. The piston rod 14 connected with the piston is advancing and depressing the valve seat 17*a*. Accordingly, the valve body 16*a* is moved down, leaving the top of the tub open. The complete depression of the valve seat is detected by $LS_5$ mounted on the exterior of the cylinder 30. Upon completion of the discharge of the contents, the interior of the tub, the bottom lid 21*a*, and other parts are cleaned. Then, after the elapse of the time period preset by a timer for discharging the contents, the fluid-operated cylinder 56 is actuated, having pressurized fluid to be introduced into the piston side. The piston causes the piston rod 57 to advance in the direction of an arrow 61 in FIG. 5, moving the roller 55 on the arm link 54 up around its pin 53. In this way, the hinged plate 22*a*, which is now in its open position, is being pushed up by the roller until it reaches its closed position as indicated by the dot-dash lines in FIG. 5, where the hinged plate is automatically brought to rest. Hence, the opening 47*a* is completely closed by the bottom lid 21*a*. This closure is then detected by $LS_1$ which responds to the complete extension of the piston rod, delivering an output signal which actuates the cylinder 59 to have pressurized fluid introduced into the piston side. The piston causes the piston rod 60 to advance in the direction of an arrow 63 in FIG. 5 until it reaches the hook member 32*a*. As the hook member 32*a* is being pushed by the piston rod 60, it turns about the pin 52*a* in the direction of an arrow 67 in FIG. 6. The piston rod 60 advances to the position indicated by the dot-dash lines in FIG. 5, and this advance position is detected by $LS_3$ located on the exterior of the cylinder 59. Finally, the hook member 32*a* is placed at the position indicated by the solid lines in FIG. 5, with its nail 72*a* facing the recess 48*a* on the hinged plate 48*a*. An output signal provided by $LS_1$ in response to the above advance position of the piston rod 60 causes pressurized fluid to be introduced into the piston rod side of the cylinder 56, causing the piston rod 57 to be retracted. The retract of the piston rod is detected by $LS_2$ on the cylinder 56, which delivers a signal which stops the operation of the cylinder 56. The output signal of $LS_2$ also causes pressurized fluid to be introduced into the piston rod side of the cylinder 59, causing the piston rod 60 to be retracted. The retract of the piston rod is detected by $LS_4$ on the exterior of the cylinder 59, the signal of which disactivates the cylinder 59 into stop. Upon completion of the above-described sequential operation, the hinged plate 22*a* has now automatically been brought into engagement with the hook member 32*a* by means of their respective recess 48*a* and nail 72*a*. Thus, the bottom opening 47*a* of the tub 6*a* is completely closed by the bottom lid 21*a*. In reopening the bottom lid, as described earlier, its opening movement can be regulated so that the lid can gradually be opened. That is, initially the lid is opened to a small degree, allowing a limited amount of the contents or mass to be discharged through the partial opening, and then is opened gradually larger to allow the rest of the mass to be discharged in parts. This gradual reopening of the lid is effective in preventing the discharge of the mass all at once through the chute 34 upon the mass separation 33 below.

The mass, which is gradually being thrown out onto the mass separator 33 as described above, travels on the separator 33 in the direction of an arrow 73 in FIG. 2 where the mass containing the surface-finished works and abrasive media are separated into the two, the works being transported to the next processing step while the abrasive media being sieved through the separator 33 down into a bucket 37 below. Concurrently with the above operation, works to be surface-finished which travel on the work feeding conveyer 36 are delivered into the bucket 37 through the expandable chute 75 which is located at the end of the conveyer 36. Upon completion of the delivery (which is controlled by a timer), the motor 74 driven, causing the media return conveyer 38, which is endless, to travel in the direction of an arrow 69 in FIG. 1. Concurrently with the start of the travel of the conveyer 38, a compound contained in a compound tank 46 is supplied into the tub 6*a* in position, and the bucket 37 is moved up to above the media return conveyer 38 and is then inverted, allowing the works and abrasive media to be dumped onto the media return conveyer 38. The conveyer 38 transports the works and media up to the funnel-shaped receiver 12*a*, through which they are thrown into the tub 6*a*. This charging time period is controlled by a timer, and at the end of the preset time period, the timer delivers an output signal which enables the bucket 37 to be lowered back to its original position, and which also causes pressurized fluid to be introduced into the piston rod side of the fluid-operated cylinder 30. When the piston rod 14 is completely retracted into the cylinder 30, this is detected by $LS_6$, which delivers a stop signal that disactuates the cylinder into stop. This concludes the operation from the discharging to recharging of the contents. That is, the output signal from $LS_6$ also enables the stepped motor with a brake 29 to be driven, causing the turret pair 5*a* and 5*b* to be rotated in short and uniform angular movements until the tub 6*b* is placed at the prescribed stop position where the tub 6*a* was previously placed. The same discharging and recharging operation as described above with regard to the tub 6*a* occurs for the tub 6*b*.

At the end of the discharging and recharging operation for both the tubs 6*a* and 6*b*, the stepped motor 29 and the electromagnetic clutch 28 are turned off, and the main motor 25 are energized, driving the turret pair 5*a* and 5*b* for high-speed rotation. During the high-speed rotation of the turret pair, the tubs 6*a* and 6*b* both revolve with the turret pair (orbital revolution) and turn around on their respective axes (axial rotation), the axial rotation being effected by means of the sprocket or chain wheels 7*a*, 7*b* on the tubs and the sprocket or chain wheels 9*a*, 9*b* on the main shaft 1 which are linked by the chains 8*a*, 8*b*. Both the orbital revolution and axial rotation produce a powerful centrifugal force, the action of which causes a flow in the contents or mass. During the flow of the mass, the works are being surface-finished by the rubbing action of the abrasive media against the works.

For the work surface finish processing, for example, it is desirable that the tubs have polygonal shapes with five to eight sides, and the pitch circles for the chain wheel 7*a* (7*b*) and chain wheel 9*a* (9*b*) have an equal diameter ratio (or equal number of teeth for both), with the number of orbital revolutions N and number of axial rotations n being equal but the direction of the rotation being opposed, in order to satisfy the condition of $n/N=-1$. When the above requirements are met, it is demonstrated that the mass can have an upper flow layer, improving the surface finish processing efficiency.

When the same abrasive media are used over again for several cycles of the surface-finish processing, they usually become worn out, resulting in a decrease in the volume of the media relative to the amount of works to be surface-finished. When this occurs, the charging of works to be processed for a next cycle into the bucket 37 is stopped, and the bucket 37 containing only the worn-out media is raised and inverted, allowing the media to be dumped onto the media return conveyer 38. Then, the motor 74 is started to cause the media return conveyer 38 to travel in the opposite direction as indicated by an arrow 70. At the opposite end of the conveyer, the media on the conveyer are returned through the chute 40 into the media hopper 39 which contains a supplemental supply of abrasive media. The media hopper 39 has a lid 42 whose opening and closing are controlled by a fluid-operated cylinder 41, the opening and closing timing being preset by a timer. When the hopper 39 is then opened, it allows the required amount of media for one cycle of the operation to be dumped onto the mass separator 33, through which the media are collected back into the bucket 37. The appropriate amount of works to be surface-finished can also be fed into the bucket 37 while the media are being collected back into the bucket through the mass separator 33. All the subsequent operations occur as previously described.

The construction and operation of the machine according to the present invention have fully been described. As readily understood from the foregoing description, the present invention provides various advantages and merits with particular regard to the simplified construction, easy closing and reopening for the top valve body and bottom lid, and the reduced running time that results from the easy closing and reopening operation. The present invention pertains to the centrifugal barrel finining machine of the type that includes the high-speed turrets carrying tubs or barrels which also rotates on their axes and is intended for the surface-finishing, stirring, mixing and/or milling, wherein the above advantages and merits are realized by providing a plurality of upright tubs on the turret pair with the top valve-operated cover which closes and reopens the top opening of each tub by causing it to be moved up and down, and a combination of the bottom lid and hinged plate which are connected by means of springs, the closing and reopening of the lid and hinged plate combination being accomplished by causing the hinged plate disengageably to engage the hook. As the springs that are interposed between the bottom lid and hinged plate provide a uniformly distributed pressure and an appropriate amount of elastic force that brings the lid in contact with the bottom opening edge, the opening can tightly be closed by the lid. As there is nothing within the tubs that physically restricts the capacity and the opening at the top is closed in operation, it is possible to make full and effective use of the total capacity of the tubs. In addition, the simple construction of the tubs provides the ideal centrifugal barrel finishing machine.

Although the present invention has been described by referring to the preferred embodiment thereof, it should be understood that various changes and modifications may be made within the spirit and scope of the invention.

What is claimed is:

1. A centrifugal rotary barrel-type finishing machine including a high-speed turret carrying tubs or barrels rotating about their axes, wherein the machine comprises:

a plurality of upright tubs arranged at regular intervals circumferentially on the turret, each of the tubs having openings at the top and at the bottom;

automatic valve means capable of movement up and down and for thereby closing and reopening the top opening of the tub;

means for closing and reopening the bottom opening of the tub, including a combination of a bottom lid covering the opening and a hinged plate, said hinged plate being pivotally supported at one end on one side of the tub bottom opening;

hook means pivotally supported at one end on the other side, for disengageably engaging said hinged plate.

2. A centrifugal rotary barrel-type finishing machine as defined in claim 1, wherein said automatic valve means includes a valve stem or rod passing through the top opening of the tub down to the middle of the tub, and a cone-shaped valve body connected to the bottom end of said valve stem and for closing and reopening the top opening from the inside of the tub, said valve stem being biased by springs toward the closing direction of said valve body.

3. A centrifugal rotary barrel-type finishing machine as defined in claim 1, wherein said hinged-plate has a recess at the other end which disengageably engages said hook means.

4. A centrifugal rotary barrel-type finishing machine as defined in claim 1, wherein said bottom lid and hinged plate are connected by means of springs and said bottom lid is capable of sliding movement relative to said hinged plate when the lid closes and reopens the bottom tub opening.

* * * * *